US011828100B2

(12) United States Patent
Benedetti et al.

(10) Patent No.: US 11,828,100 B2
(45) Date of Patent: Nov. 28, 2023

(54) HINGE DEVICE FOR DOOR LEAVES IN GLASS OR THE LIKE

(71) Applicant: Colcom Group S.p.A., Nave (IT)

(72) Inventors: Luca Benedetti, Nave (IT); Mihai Mesaros, Nave (IT)

( * ) Notice: Subject to any disclaimer, the term of this patent is extended or adjusted under 35 U.S.C. 154(b) by 153 days.

(21) Appl. No.: 17/432,937

(22) PCT Filed: Feb. 20, 2020

(86) PCT No.: PCT/IB2020/051429

§ 371 (c)(1),
(2) Date: Aug. 22, 2021

(87) PCT Pub. No.: WO2020/201846

PCT Pub. Date: Oct. 8, 2020

(65) Prior Publication Data

US 2022/0154509 A1 May 19, 2022

(30) Foreign Application Priority Data

Mar. 29, 2019 (IT) ..... 102019000004791

(51) Int. Cl.
*E05F 3/20* (2006.01)

(52) U.S. Cl.
CPC ..... *E05F 3/20* (2013.01)

(58) Field of Classification Search
CPC ..... E05F 3/20; E05F 3/14; E05F 1/1223
See application file for complete search history.

(56) References Cited

U.S. PATENT DOCUMENTS

| | | | | |
|---|---|---|---|---|
| 6,205,619 | B1 * | 3/2001 | Jang | E05D 5/10 16/50 |
| 9,487,988 | B2 * | 11/2016 | Bacchetti | E05F 3/20 |
| 9,605,462 | B2 * | 3/2017 | Bacchetti | E05F 3/12 |
| 9,856,686 | B2 * | 1/2018 | Bacchetti | E05F 3/12 |
| 9,926,732 | B2 * | 3/2018 | Bacchetti | E05F 3/04 |
| 10,633,905 | B2 * | 4/2020 | Feng | E05F 3/14 |
| 11,377,891 | B2 * | 7/2022 | Salice | E05D 3/16 |

(Continued)

FOREIGN PATENT DOCUMENTS

| | | |
|---|---|---|
| EP | 3067502 | 9/2016 |
| IT | VI20120258 | 4/2014 |

(Continued)

*Primary Examiner* — Victor D Batson
*Assistant Examiner* — Matthew J Sullivan
(74) *Attorney, Agent, or Firm* — Themis Law

(57) ABSTRACT

A hinge device for the controlled rotary opening and closing movement of a closing element anchored to a stationary support structure includes a fixed element and a movable element rotatable between a first open position and a closed position. The movable element includes an end portion, a working chamber, a shaft inserted therein, and a stem slidingly inserted into the shaft. A pin connects the end portion, the shaft, and the stem. The working chamber includes a working fluid for the hydraulic damping of the mutual movement of the fixed and movable elements and an elastic damping element causing the stem to abut thereagainst only when the stem is in an end-stop position, so that a user moving the closing element feels the resistance of the elastic damping element only upon reaching the first open position.

8 Claims, 11 Drawing Sheets

(56) References Cited

U.S. PATENT DOCUMENTS

| | | | | |
|---|---|---|---|---|
| 2010/0109371 | A1* | 5/2010 | Shoemaker | F16F 9/0481 296/76 |
| 2018/0238092 | A1* | 8/2018 | Feng | E05F 3/14 |
| 2019/0145141 | A1* | 5/2019 | Jo | E05F 3/14 16/54 |
| 2020/0217119 | A1* | 7/2020 | Feng | E05D 3/02 |
| 2020/0332581 | A1* | 10/2020 | Balbo di Vinadio | E05F 3/12 |
| 2021/0180381 | A1* | 6/2021 | Wu | E05F 3/20 |
| 2022/0049535 | A1* | 2/2022 | Yoshida | F16F 9/145 |
| 2022/0195770 | A1* | 6/2022 | Benedetti | E05D 5/0246 |
| 2022/0298840 | A1* | 9/2022 | Benedetti | E05F 3/12 |

FOREIGN PATENT DOCUMENTS

| | | |
|---|---|---|
| WO | 2006025663 | 3/2006 |
| WO | 2016055929 | 4/2016 |

* cited by examiner

HINGE DEVICE FOR DOOR LEAVES IN GLASS OR THE LIKE

FIELD OF THE INVENTION

The present invention is generally applicable to the technical field of hinges for closing and controlling door leaves for showcases or similar closing elements, and in particular it regards a hinge device for the movement and for the controlled rotary opening and closing of a closing element, such as for example a glass door leaf of a showcase or the like, anchored to a stationary support structure, such as for example a frame.

STATE OF THE ART

It is known to use plexiglass showcases used to contain foodstuffs, such as for example bread, which are easily accessible to users by rotating the door leaf around a horizontal or vertical hinging axis.

As known, hinges comprise a movable element, usually fixed to the door leaf of the showcase, or the like, hinged to a fixed element, usually fixed to the support frame of the latter.

Often, such hinges are mainly of the mechanical type and they do not provide any kind of opening and/or closing control.

It is also known that such door leaves are subject to possible forced opening due to the use of incautious users.

As a matter of fact, such known devices do not provide an opening block and the door leaves are therefore subject to possible unhinging and/or damage.

Furthermore, in the light of the aforementioned inconveniences, it is not known to use the glass to make the door leaves of the showcases in question, with ensuing limitation of the materials used for making the same.

SUMMARY OF THE INVENTION

An object of the present invention is to at least partly overcome the aforementioned drawbacks, by providing a hinge device that is highly functional, easy to manufacture and inexpensive.

Another object of the invention is to provide a hinge device that allows a simple and practical adjustment of the opening and closing of the closing element to which it is constrained.

Another object of the invention is to provide a hinge capable of guaranteeing the controlled movement of the door leaf to which it is constrained, both during the opening and closing.

Another object of the invention is to provide a hinge device suitable for the controlled opening and closing of glass door leaves.

Another object of the invention is to provide a hinge device that has a minimum number of components.

Another object of the invention is to provide a hinge device capable of maintaining the exact closing position over time.

Another object of the invention is to provide a hinge device that is extremely safe.

Another object of the invention is to provide a hinge device that is extremely easy to install.

These and other objects to be further clarified hereinafter, are achieved by a hinge device having one or more of the characteristics described and/or claimed and/or illustrated herein.

Advantageous embodiments of the invention are defined according to the dependent claims.

BRIEF DESCRIPTION OF THE DRAWINGS

Further characteristics and advantages of the invention will be more apparent in the light of the detailed description of some preferred but non-exclusive embodiments of a hinge device according to the invention, illustrated by way of non-limiting example with reference to the attached drawings, wherein:

FIG. 1B is an axonometric view of the shaft 30, regarding which

FIG. 2A is a lateral view of the hinge device 1 of FIG. 1A in which the closing element A is in closed position, regarding which

FIG. 3A is a lateral view of the hinge device 1 of FIG. 1A in which the closing element A is open by an angle β equal to 180°, regarding which

FIG. 4A is a front view of the hinge device 1 of FIG. 1A, regarding which

FIG. 6A is a front view of the assembly consisting of the hinge device 1 and the closing element A, regarding which

FIG. 7A is an axonometric view of the hinge device 1 in which the closing element A is in closed position, regarding which

FIG. 8A is an axonometric view of the hinge device 1 in which the closing element A is in the first open position, regarding which

FIG. 9A is an axonometric view of the hinge device 1 wherein the closing element A is in the third open position (in which the angle β has a value comprised between 85° and 110°, in particular 110° in this case), regarding which

FIGS. 10A and 11A are axonometric views of the hinge device 1 wherein the closing element A is in the second open position (in which the angle β has a value comprised between 110° and 180°, in particular 165° and 180° in this case), regarding which

FIG. 13A is a top view of the valve means 60 of the embodiment illustrated in FIG. 12B, regarding which

DETAILED DESCRIPTION OF SOME PREFERRED EMBODIMENTS

With reference to the mentioned figures, herein described is a hinge device 1 for the controlled rotary opening and closing movement of a closing element A, such as a door leaf or the like preferably in glass, anchored to a stationary support structure S, such as a frame preferably in glass.

The present invention can include various parts and/or similar or identical elements. Unless otherwise specified, similar or identical parts and/or elements will be indicated using a single reference number, it being clear that the described technical features are common to all similar or identical parts and/or elements.

Generally, the hinge device 1 can include a fixed element 10 that can be anchored to the frame S and a movable element 20 that can be anchored to the door leaf A.

Figure 7A:
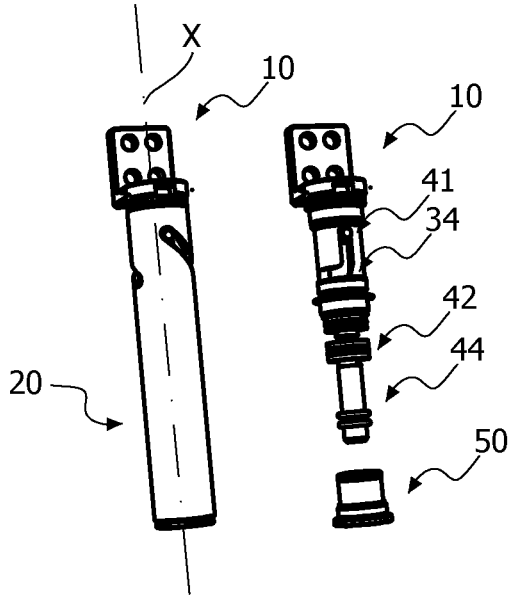
Figure 7B:
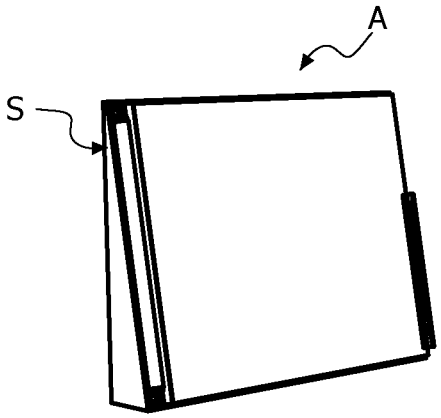
FIGS. 7B and 7C are the corresponding axonometric and top views of the assembly consisting of a pair of hinge devices 1 and the closing element A.
Figure 7C:
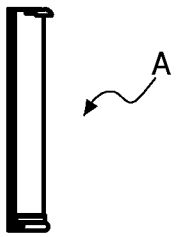
Figure 8A:
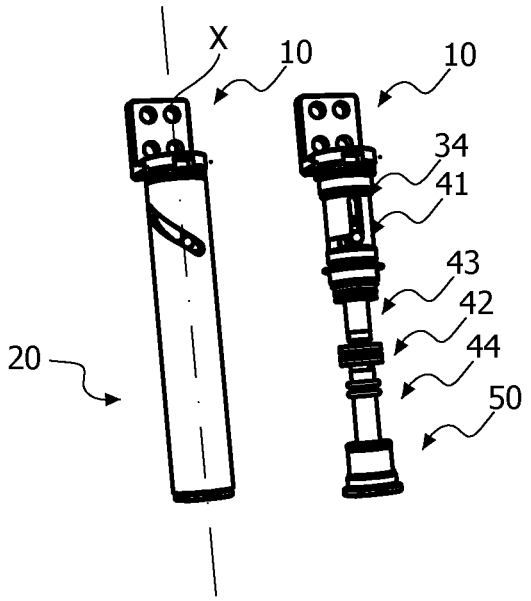
Figure 8B:
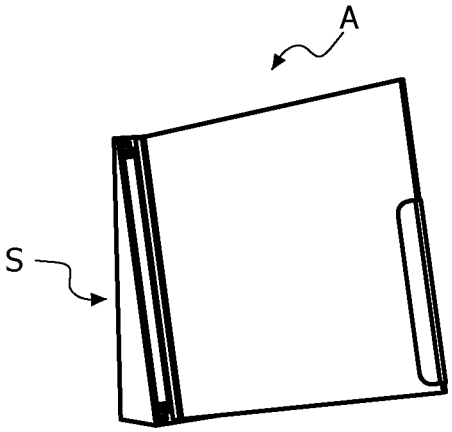
FIGS. 8B and 8C are the corresponding axonometric and top views of the assembly consisting of a pair of hinge devices 1 and the closing element A.
Figure 8C:
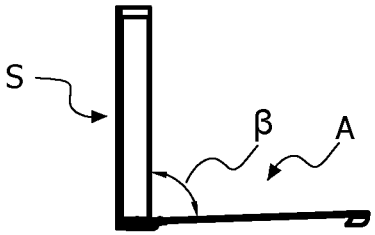

Suitably, the fixed 10 and movable 20 elements will be coupled to each other so as to rotate around a longitudinal axis X between a closed position, illustrated for example in FIG. 7A, and at least one open position, illustrated for example in FIG. 8A.

Suitably, the fixed 10 and movable 20 elements can include a respective first and second fixing portion 15, 25 for anchoring to the frame S and to the door leaf A.

Preferably, the movable element 20 can include a working chamber 21 defining the axis X and a stem 40 (shown in exploded view in FIG. 1D) slidable therein between at least two end-stop portions.

The working chamber 21 can also comprise elastic damping means 50 which are susceptible to abut against the stem 40 so as to dampen the motion thereof by imparting an opposing force so as to oppose the movement of the door leaf A by the user, as will be described in more detail below.

According to a preferred but not exclusive embodiment, the stem 40 can be coupled to a plunger element 42 so that they slide integrally along the axis X.

The stem 40 can comprise a portion 43 comprising an end 43' at which a housing hole 43''' into which a pin 41 can be inserted can be provided.

The portion 43 can further comprise an end 43" coupled, preferably by screwing, to the plunger element 42.

Suitably, the stem 40 can further comprise a portion 44 comprising an end 44' coupled to the plunger element 42, preferably by screwing, and an opposite end 44" suitable to abut against the elastic damping means 50.

Figure 2A:
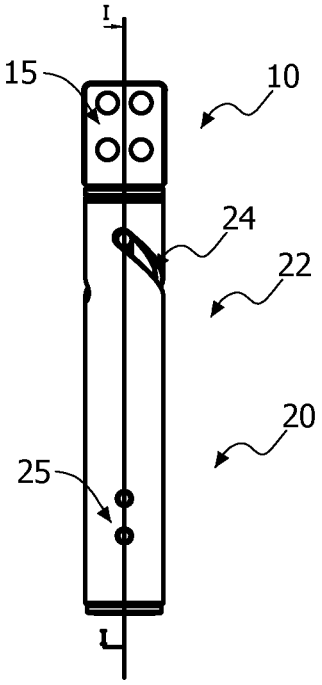
Figure 2B:
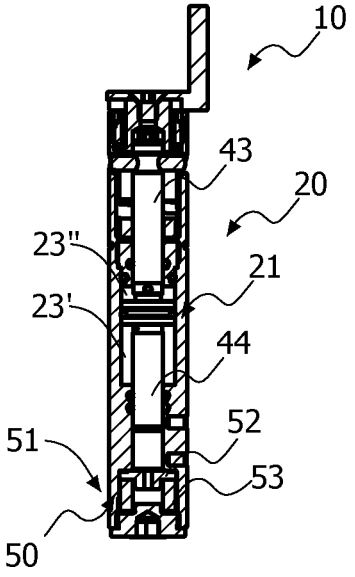
FIG. 2B is a sectional view taken along a plane I-I.
Figure 3A:
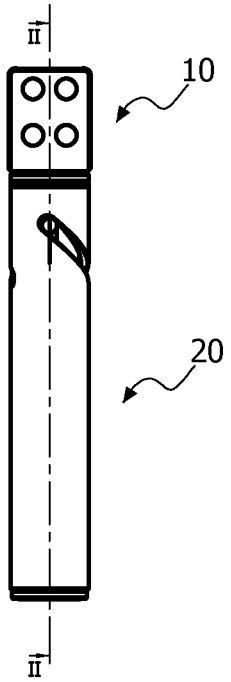
Figure 3B:
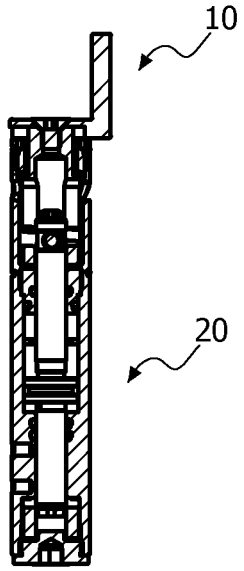
FIG. 3B is a sectional view taken along a plane II-II.

As particularly illustrated in FIG. 2B, the working chamber 21 can comprise a housing area 51 in which the elastic damping means 50 can be accommodated.

Figure 4A:
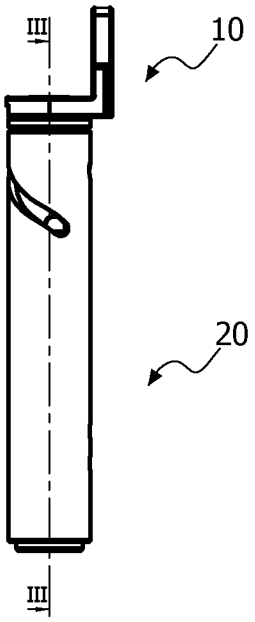
Figure 4B:
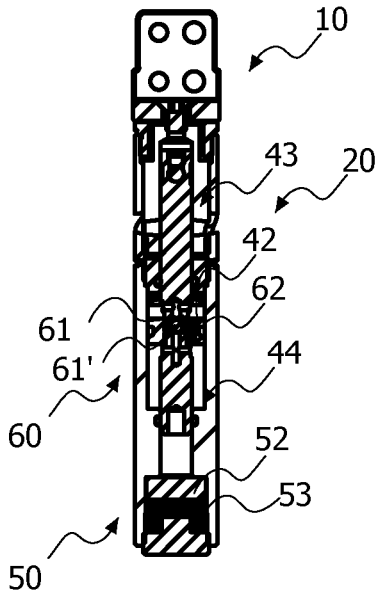
FIG. 4B is a sectional view taken along a plane III-III.
Figure 5:
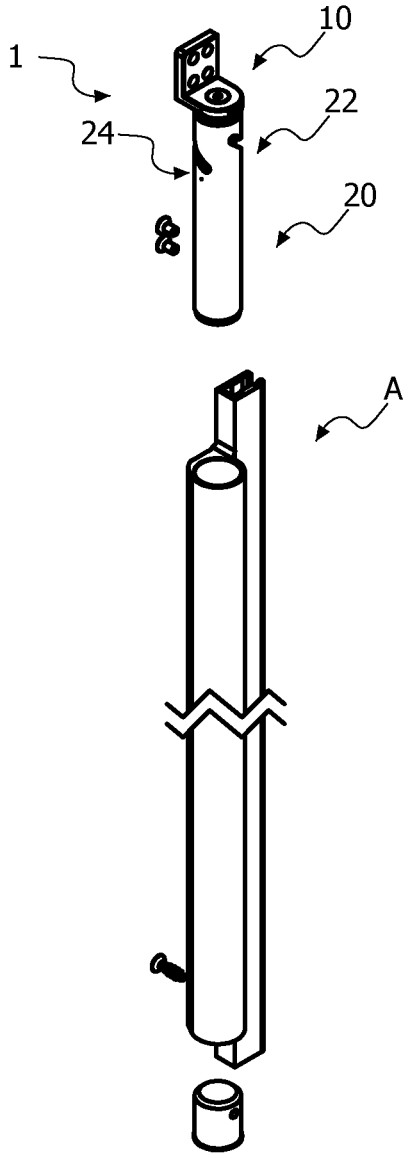
FIG. 5 is an axonometric view of the hinge device 1 and of a portion of the closing element A that can be directly coupled to the hinge device 1.
Figure 6A:
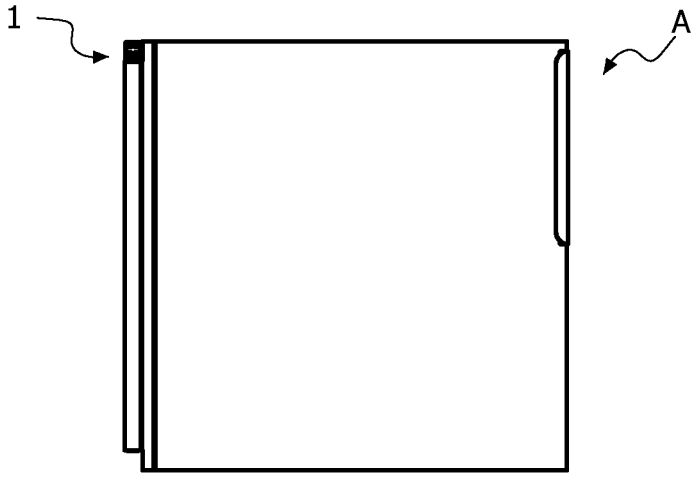
Figure 6B:
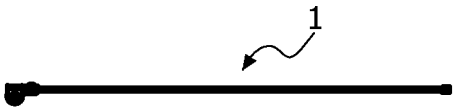
FIGS. 6B and 6C are top and lateral views, respectively.
Figure 6C:
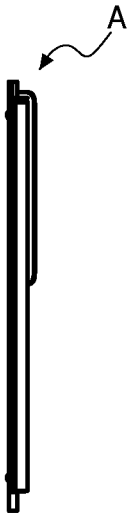

These can comprise a pressing member 52 and a damping element 53, such as for example a belleville washer, as illustrated in FIG. 4B, or a polyurethane elastomer body, as illustrated in FIG. 2B, suitable to occupy the housing area 51 upon the compression thereof.

Such damping elements 53 can impart a high opposing force upon minimal compressions.

Conveniently, the working chamber 21 can include a working fluid for the hydraulic damping of the movement of the movable element 20 around the axis X.

Conveniently, the plunger element 42 can divide the working chamber 21 into a first and a second variable-volume compartment 23', 23", which can be placed in fluid communication using valve means 60.

Such valve means 60 can comprise a calibrated opening 62 and an opening 61 comprising a shutter 61' susceptible to open when the door leaf A is opened and close when the door leaf is closed, so as to force the working fluid to flow exclusively through the second calibrated opening 62, as disclosed in the applications PCT/IB2015/050603, PCT/IB2017/05836 or in the Italian application 102018000008233.

Preferably, the opening 61 and the shutter 61' can be part of a check valve.

Even more preferably, the calibrated opening 62 can have a diameter of suitable size, possibly small, so as to dampen the closure of the door leaf A, depending on the desired degree.

Conveniently, the hinge device 1 can comprise a shaft 30 inserted into the working chamber 21 along the axis X.

The shaft 30 can comprise a connection portion 31 for connecting the fixed 10 and movable 20 elements.

The shaft 30 can also comprise a tubular working portion 32 opposite the connection portion 31.

Suitably, the tubular working portion 32 can comprise a pair of slots 34 facing each other.

Each slot 34 can comprise a portion 35 extending along an axis X' parallel to the axis X and a portion 37 extending along an axis Y.

Figure 1A:
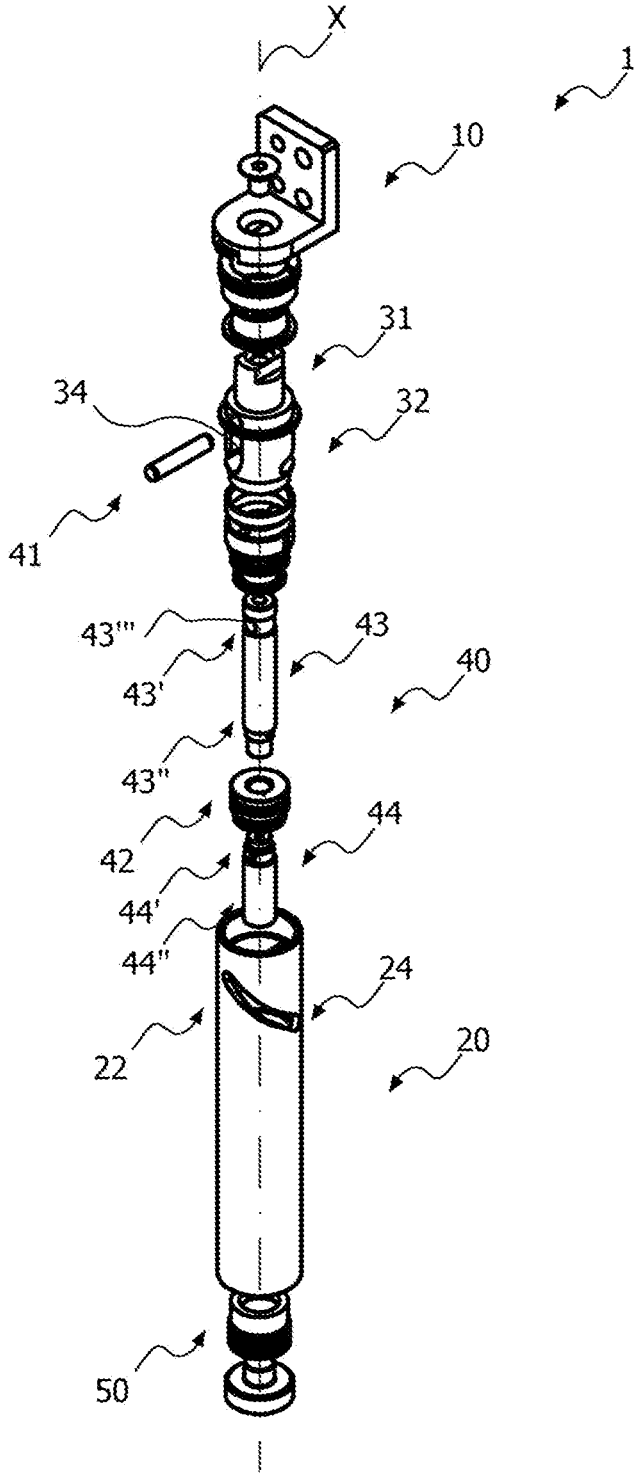
FIG. 1A is an exploded view of a hinge device 1.
Figure 1D:
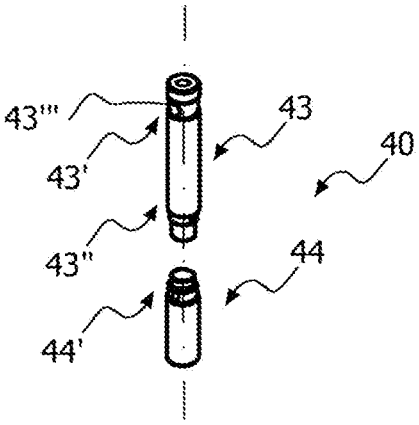
FIG. 1D shows the stem 40, with stem portions 43 and 44 shown in exploded view.
Figure 1B:
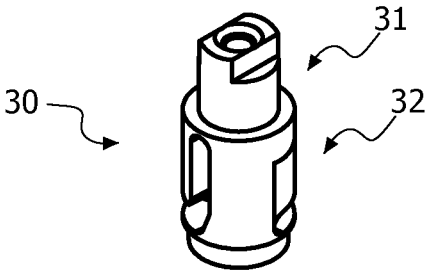
Figure 1C:
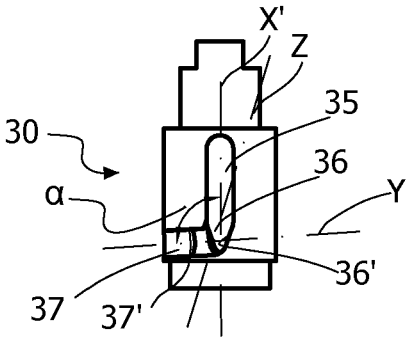
FIG. 1C is a lateral view.

Preferably, the axis Y can be incident to the axis X' so that an angle $\alpha$ greater than 90° can be defined between the portion 35 and the portion 37, as shown in particular in FIG. 1C.

It is clear that the angle $\alpha$ can be substantially equal to 90°, without departing from the scope of protection of the attached claims.

Suitably, a portion 36 defining an axis Z substantially transversal with respect to the axes X' and Y, can be interposed between the portions 35 and 37.

The portion 36 can comprise a guide surface 36' inclined corresponding to the axis Z.

According to a preferred but non-exclusive embodiment, the working chamber 21 can further comprise an end portion 22 comprising a pair of actuator slots 24.

Preferably, the slots 24 can be arranged facing each other and rotating around the axis X.

More particularly, the slots 24 can have a rightward or leftward development.

According to the embodiment illustrated in FIG. 1A, the slots 24 can have a leftward development.

Conveniently, the stem 40 can be inserted into the tubular working portion 32 so that the pin 41 can slide along the slots 24 and 34.

In particular, each pair of slots 24 and 34 can constitute a single guide element for the pin 41.

More particularly, during the movement of the door leaf A and thus upon the rotation of the fixed element 10 and the movable element 20 around the axis X, the slots 24 can guide the movement of the pin 41 along the slots 34.

However, it is clear that a single pair of slots can be formed in the tubular working portion 32 or in the movable element 20 without departing from the scope of protection of the attached claims.

Furthermore, it is clear that two or more slots can be formed in the tubular working portion 32 and/or in the end portion 22 without departing from the scope of protection of the attached claims.

Operatively, as particularly illustrated in FIG. 8A, when the door leaf A is moved to open by an angle $\beta$ comprised for example between 0° and 85°, the pin 41 can slide along the portion 35 and the stem 40 can be moved from a first end-stop position in which the end 43' is proximal to the connection portion 31 of the shaft 30, to a second end-stop position in which the end 43' is distal therefrom.

More particularly, when the door leaf A is in a first opening position, corresponding for example to an angle β of 85°, the end 44" of the stem 40 will come into contact with the pressing member 52.

Starting from this angle, the door leaf A can close automatically in a damped manner solely due to the action of the previously described hydraulic circuit.

Figure 9A:
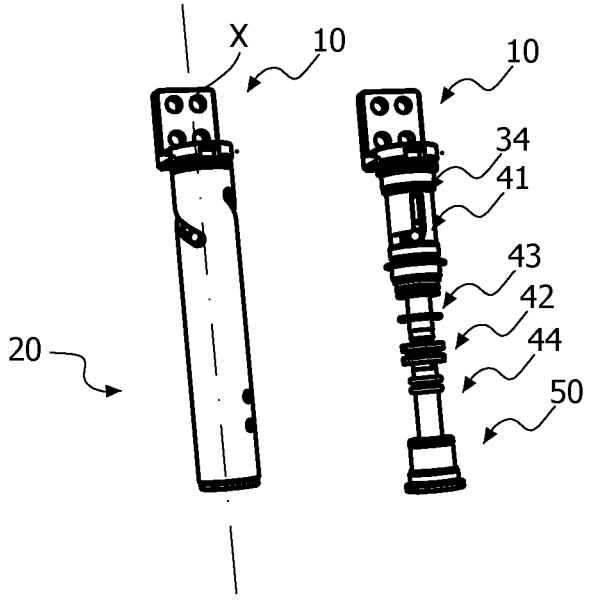
Figure 9B:
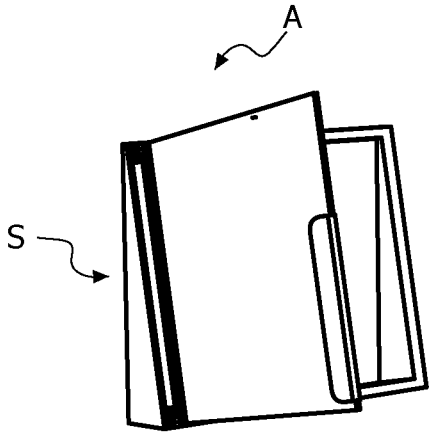
FIGS. 9B and 9C are the corresponding axonometric and top views of the assembly consisting of a pair of hinge devices 1 and the closing element A.
Figure 9C:
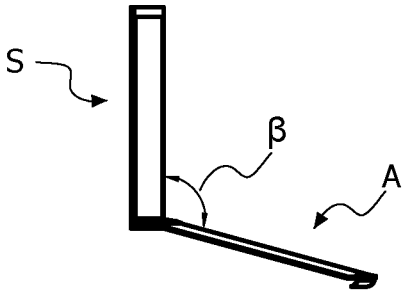
Figure 10A:
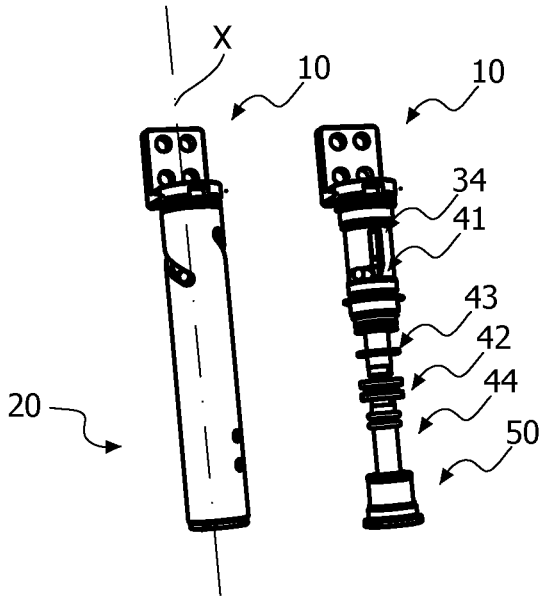
Figure 10B:
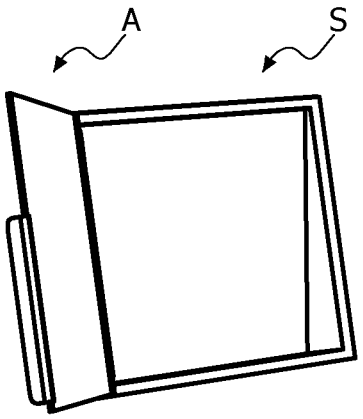
FIGS. 10B, 11B and 10C, 11C are the corresponding axonometric and top views of the assembly consisting of a pair of hinge devices 1 and the closing element A.
Figure 10C:
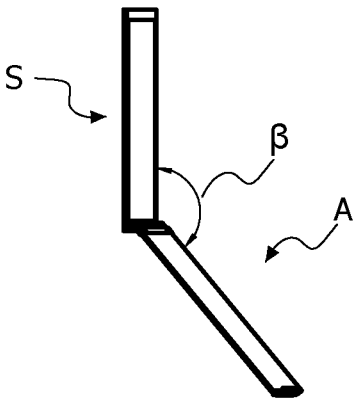
Figure 11A:
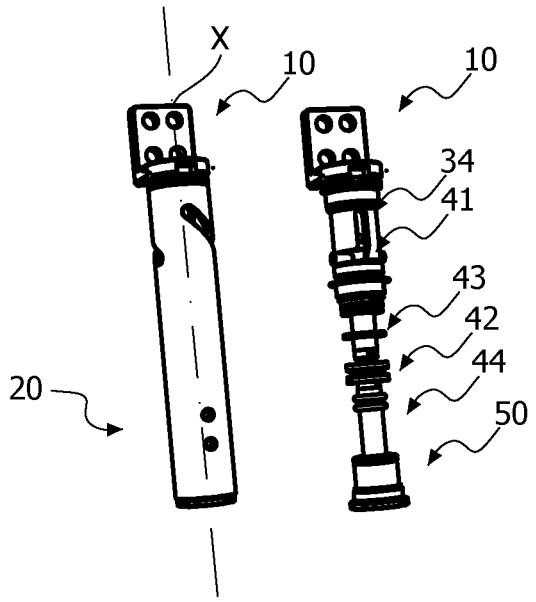
Figure 11B:
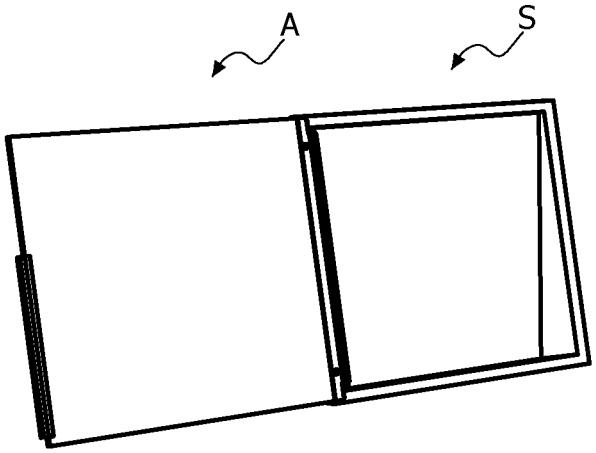
Figure 11C:
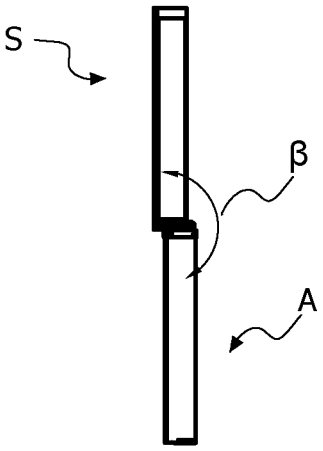
Figure 12A:
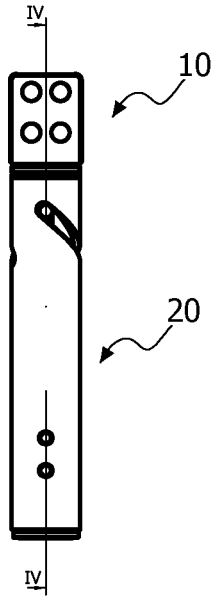
FIG. 12A is a lateral view of the hinge device 1 of FIG. 1A wherein the valve means 60 are in a further embodiment.
Figure 12B:
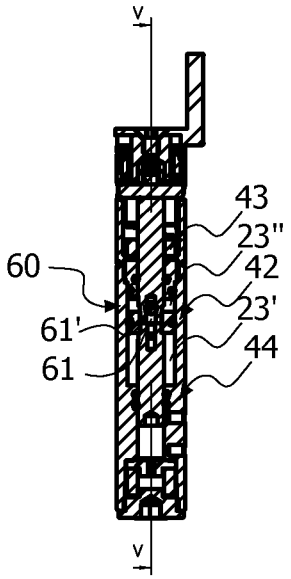
FIGS. 12B and 12C are respectively a sectional view along a plane IV-IV and a sectional view along a plane V-V of the embodiment of FIG. 12A.
Figure 12C:
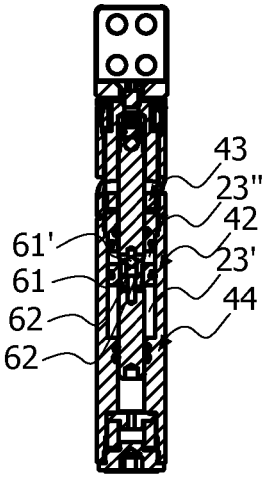
Figure 13A:
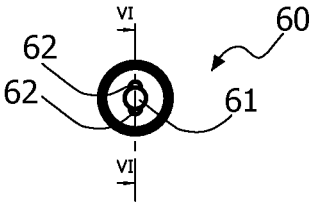
Figure 13B:
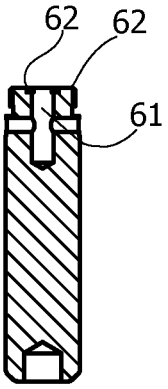
FIG. 13B is a sectional view along a plane VI-VI.

As shown in FIG. 9A, when the door leaf A is moved to open by an angle β comprised between 85° and 110°, corresponding to a third open position, the pin 41 can slide along the portion 36 and the stem 40 can be moved from the second to a third end-stop position with ensuing compression of the damping element 53.

Starting with a value of β comprised between 85° and 110°, the door leaf A can thus be closed automatically due to the work of the damping means 50 which will push the pin 41 to abut against the guide surface 36' which will direct the pin 41 along the portion 35 to reach the aforementioned first open position.

Starting from such position, the door leaf A can reach the closed position as described previously.

Furthermore, such closure can be suitably damped by the previously described hydraulic circuit.

As illustrated in FIGS. 10A-11A, when the door leaf A is moved to open by an angle β comprised between 110° and 180°, corresponding to a second open position, the pin 41 can slide along the portion 36 and the stem 40 can be moved from the third to a fourth end-stop position with ensuing further compression of the damping element 53.

In particular, as a result of opening angles β greater than 110°, the door leaf A will lock in the position reached due to the countering force generated by the damping element 53 which will push the pin 41 to abut against the abutment surface 37' of the portion 37, as particularly illustrated in FIGS. 10A-11A.

The user will then have to manually return the door leaf A up to an angle β measuring 110°, starting from which the door leaf A can be closed automatically as described previously.

It is clear that, during the opening of the door leaf A and as concerns opening angles β comprised between 85° and 180°, the user can perceive a resistance against the increasing movement, due to the incremental countering force generated by the progressive compression of the damping element 53.

This resistance will cause the user to avoid forcing the door leaf A to open, preventing it from unhinging it.

It is clear that the described hinge device 1 can guarantee the controlled rotary opening and closing movement of closing elements A, in particular glass door leaves.

In light of the above, it is clear that the invention attains the pre-set objectives.

The invention is susceptible to numerous modifications and variants all falling within the inventive concept outlined in the attached claims. All details can be replaced by other technically equivalent elements, and the materials can be different depending on the technical needs, without departing from the scope of protection defined by the attached claims.

The invention claimed is:

1. A hydraulic hinge device for a controlled rotary opening and closing movement of a closing element (A) anchored to a stationary support structure (S), comprising:

a fixed element (10) configured to be anchored to the stationary support structure (S);

a movable element (20) configured to be anchored to the closing element (A), said movable element (20) and said fixed element (10) being mutually coupled to rotate around a first axis (X) between at least one first open position and one closed position, one of said movable element (20) or said fixed element (10) comprising at least one working chamber (21) defining said first axis (X);

a shaft (30) coaxially inserted into said at least one working chamber (21), said shaft (30) comprising a connection portion (31) for operatively connecting said fixed and movable elements (10, 20) to each other, said shaft (30) further comprising a tubular working portion (32); and a stem (40) telescopically inserted into said tubular working portion (32) so as to slide along said first axis (X) between a first end-stop position proximal to said connection portion (31) of said shaft (30), corresponding to one of said at least one open position or one closed position, and at least one second end-stop position distal from said connection portion (31) of said shaft (30), corresponding to another one of said at least one open position and one closed position, a pin (41) operatively connecting said tubular working portion (32) and said stem (40) being provided for so that a sliding of said stem (40) along the first axis (X) or an axis parallel thereto corresponds to a rotation of said one of said movable element (20) or said fixed element (10) around said first axis (X);

wherein said at least one working chamber (21) houses a working fluid for a hydraulic damping of a mutual movement of said fixed and movable elements (10, 20) and at least one plunger element (42) integrally coupled with said stem (40) to integrally move therewith along said first axis (X), said at least one plunger element (42) dividing said at least one working chamber (21) into at least one first and one second variable-volume compartment (23', 23") fluidly communicating with each other, a valve (60) being provided to control a flow of the working fluid between said first and said second variable-volume compartments (23', 23");

wherein said at least one working chamber (21) further comprises elastic damping means (50) in a spatial relationship with said stem (40) so that the stem or said plunger element (42) abuts against the elastic damping means exclusively when said stem (40) is in said second end-stop position, so that a user who moves the closing element (A) feels a resistance of said elastic damping means (50) exclusively upon reaching of the closed position or the first open position;

wherein said stem (40) comprises an end (40") inserted into said tubular working portion (32) of said shaft (30) which includes said pin (41), one of the stem or said movable or fixed element comprising at least one pair of first actuator slots (24) rotating around said first axis (X), said pin (41) being inserted into said first actuator slots (24) to slide therethrough upon a mutual rotation of said fixed and movable elements (10, 20) around said first axis (X); and wherein said at least one working chamber (21) includes at least one end portion (22) mutually facing another one of said movable element (20) or said fixed element (10), said shaft (30) being coaxially inserted into said at least one working chamber (21) at said end portion (22), one of said at least one end portion (22) of said working chamber (21) and said tubular working portion (32) of said shaft (30) comprising said first actuator slots (24), another one of said at least one end portion (22) of said working chamber (21) and said tubular working portion (32) of said shaft (30) comprising at least one pair of second guide slots (34), said pin (41) sliding through said first actuator slots (24) and said second guide slots (34).

2. The hydraulic hinge device according to claim 1, wherein said first actuator slots (24) have rightward or a leftward development, said second guide slots (34) comprising at least one first portion (35) defining a second axis (C') parallel or inclined with respect to said first axis (X), said pin (41) sliding through said at least one first portion (35) of said second guide slots (34) so as to allow a movement of said closing element between said first open position and said closed position.

3. The hydraulic hinge device according to claim 2, wherein said second guide slots (34) further comprise a second portion (37) angularly spaced with respect to said first portion (35) so as to define a third axis (Y), said pin (41) sliding through said at least one first portion (35) and in said second portion (37) of said second guide slots (34) so as to allow a movement of said closing element between a second open position and said closed position passing through said first open position, said third axis (Y) being perpendicular or inclined with respect to said first axis (X) so that when the closing element is in said second open position, said pin (41) abuts against an abutment surface (37') of said second portion (37) under a thrust of said elastic damping means (50).

4. The hydraulic hinge device according to claim 3, wherein said second guide slots (34) further comprise a third portion (36) interposed between said first and said second portions (35, 37), said pin (41) sliding in said first, said second and said third portions (35, 36, 37) of said second guide slots (34) so as to allow the movement of said closing element between said second open position and said closed position passing through said first open position and through at least one third open position interposed between said first and said second open positions, said third portion (36) defining a fourth axis (Z) transverse with respect to said second and said third axes (C', Y) so that, when the closing element is in said third open position, said pin (41) abuts against a guide surface (36') of said third portion (36) inclined corresponding to said fourth axis (Z) so as to be automatically thrust toward said first portion (35) by said elastic damping means (50), so that the closing element snaps towards said first open position.

5. A hydraulic hinge device for a controlled rotary opening and closing movement of a closing element (A) anchored to a stationary support structure (S), comprising:

a fixed element (10) configured to be anchored to the stationary support structure (S);

a movable element (20) configured to be anchored to the closing element (A), said movable element (20) and said fixed element (10) being mutually coupled to rotate around a first axis (X) between at least one first open position and one closed position, one of said movable element (20) or said fixed element (10) comprising at least one working chamber (21) defining said first axis (X);

a shaft (30) coaxially inserted into said at least one working chamber (21), said shaft (30) comprising a connection portion (31) for operatively connecting said fixed and movable elements (10, 20) to each other, said shaft (30) further comprising a tubular working portion (32); and a stem (40) telescopically inserted into said tubular working portion (32) so as to slide along said first axis (X) between a first end-stop position proximal to said connection portion (31) of said shaft (30), corresponding to one of said at least one open position or one closed position, and at least one second end-stop position distal from said connection portion (31) of said shaft (30), corresponding to another one of said at least one open position and one closed position, a pin (41) operatively connecting said tubular working portion (32) and said stem (40) being provided for so that a sliding of said stem (40) along the first axis (X) or an axis parallel thereto corresponds to a rotation of said one of said movable element (20) or said fixed element (10) around said first axis (X);

wherein said at least one working chamber (21) houses a working fluid for a hydraulic damping of a mutual movement of said fixed and movable elements (10, 20) and at least one plunger element (42) integrally coupled with said stem (40) to integrally move therewith along said first axis (X), said at least one plunger element (42) dividing said at least one working chamber (21) into at least one first and one second variable-volume compartment (23', 23") fluidly communicating with each other, a valve (60) being provided to control a flow of the working fluid between said first and said second variable-volume compartments (23', 23");

wherein said at least one working chamber (21) further comprises elastic damping means (50) in a spatial relationship with said stem (40) so that the stem or said plunger element (42) abuts against the elastic damping means exclusively when said stem (40) is in said second end-stop position, so that a user who moves the closing element (A) feels a resistance of said elastic damping means (50) exclusively upon reaching of the closed position or the first open position;

wherein said stem (40) comprises an end (40") inserted into said tubular working portion (32) of said shaft (30) which includes said pin (41), one of the stem or said movable or fixed element comprising at least one pair of first actuator slots (24) rotating around said first axis (X), said pin (41) being inserted into said first actuator slots (24) to slide therethrough upon a mutual rotation of said fixed and movable elements (10, 20) around said first axis (X); and wherein said stem (40) comprises a first portion (43) comprising a first end (43') integrally coupled to said pin (41) and an opposite second end (43") mutually coupled to said plunger element (42), said stem (40) further comprising a second portion (44) comprising a third end (44') mutually coupled to said plunger element (42) and an opposite fourth end (44") configured to abut against said elastic damping means (50), said first portion (43), said plunger element (42) and said second portion (44) moving integrally along said first axis (X).

6. The hydraulic hinge device according to claim 5, wherein said working chamber (21) comprises a housing area (51) for said elastic damping means (50), the elastic damping means comprising at least one pressing member (52) and a damping element (53), said at least one pressing member (52) being configured to mutually abut against said fourth end (44") of said second portion (44) of said stem (40) when the closing element (A) reaches the first open position.

7. The hydraulic hinge device according to claim 6, wherein said damping element (53) is a polyurethane elastomer body configured to completely occupy said housing area (51) after said polyurethane elastomer body is compressed by said at least one pressing member (52).

8. A hydraulic hinge device for a controlled rotary opening and closing movement of a closing element (A) anchored to a stationary support structure (S), comprising:

a fixed element (10) configured to be anchored to the stationary support structure (S);

a movable element (20) configured to be anchored to the closing element (A), said movable element (20) and said fixed element (10) being mutually coupled to rotate around a first axis (X) between at least one first open position and one closed position, one of said movable element (20) or said fixed element (10) comprising at least one working chamber (21) defining said first axis (X);

a shaft (30) coaxially inserted into said at least one working chamber (21), said shaft (30) comprising a connection portion (31) for operatively connecting said fixed and movable elements (10, 20) to each other, said shaft (30) further comprising a tubular working portion (32); and a stem (40) telescopically inserted into said tubular working portion (32) so as to slide along said first axis (X) between a first end-stop position proximal to said connection portion (31) of said shaft (30), corresponding to one of said at least one open position or one closed position, and at least one second end-stop position distal from said connection portion (31) of said shaft (30), corresponding to another one of said at least one open position and one closed position, a pin (41) operatively connecting said tubular working portion (32) and said stem (40) being provided for so that a sliding of said stem (40) along the first axis (X) or an axis parallel thereto corresponds to a rotation of said one of said movable element (20) or said fixed element (10) around said first axis (X);

wherein said at least one working chamber (21) houses a working fluid for a hydraulic damping of a mutual movement of said fixed and movable elements (10, 20) and at least one plunger element (42) integrally coupled with said stem (40) to integrally move therewith along said first axis (X), said at least one plunger element (42) dividing said at least one working chamber (21) into at least one first and one second variable-volume compartment (23', 23") fluidly communicating with each other, a valve (60) being provided to control a flow of the working fluid between said first and said second variable-volume compartments (23', 23");

wherein said at least one working chamber (21) further comprises elastic damping means (50) in a spatial relationship with said stem (40) so that the stem or said plunger element (42) abuts against the elastic damping means exclusively when said stem (40) is in said second end-stop position, so that a user who moves the closing element (A) feels a resistance of said elastic damping means (50) exclusively upon reaching of the closed position or the first open position;

wherein said stem (40) comprises an end (40") inserted into said tubular working portion (32) of said shaft (30) which includes said pin (41), one of the stem or said movable or fixed element comprising at least one pair of first actuator slots (24) rotating around said first axis (X), said pin (41) being inserted into said first actuator slots (24) to slide therethrough upon a mutual rotation of said fixed and movable elements (10, 20) around said first axis (X); and wherein said valve (60) comprises at least one first and at least one second opening (61, 62) so as to place said first and said second variable-volume compartments (23', 23") in fluid communication, said at least one first opening (61) comprising at least one shutter (6) configured to open upon an opening of the closing element (A) and further configured to close upon a closing of the closing element (A) to force the working fluid to flow exclusively through said second opening (62).

* * * * *